United States Patent [19]

Fayngersh et al.

[11] Patent Number: 4,944,066

[45] Date of Patent: Jul. 31, 1990

[54] ADJUSTABLE CLOSER ARM

[75] Inventors: Zakhary Fayngersh, West Hartford; Ronald S. Slusarski, Berlin; Richard W. Schumacher, Newington, all of Conn.

[73] Assignee: Emhart Industries, Inc., Towson, Md.

[21] Appl. No.: 310,799

[22] Filed: Feb. 14, 1989

[51] Int. Cl.[5] ..... E05F 1/00

[52] U.S. Cl. ..... 16/49; 16/71; 16/237; 16/DIG. 10; 16/DIG. 17; 16/DIG. 39; 403/104; 403/106; 403/109

[58] Field of Search ..... 16/49, 50, 71, 237, 16/DIG. 39, DIG. 10; 403/104, 106, 109

[56] References Cited

U.S. PATENT DOCUMENTS

| | | | |
|---|---|---|---|
| 476,721 | 6/1892 | Baldwin . | |
| 879,384 | 2/1908 | Hillman . | |
| 2,763,341 | 9/1956 | Wentworth | 406/106 |
| 2,841,425 | 7/1958 | Oeters . | |
| 3,157,416 | 11/1964 | Sandbakken . | |
| 3,781,908 | 12/1973 | Tullos | 403/104 |
| 4,034,438 | 7/1977 | Csokasy et al. | 403/104 |
| 4,054,178 | 10/1977 | Boothe | 403/104 |
| 4,102,005 | 7/1978 | Schnarr et al. | 16/49 |
| 4,180,346 | 12/1979 | Blake | 403/109 |
| 4,182,364 | 1/1980 | Gilbert et al. | 16/DIG. 39 |
| 4,524,484 | 6/1985 | Graham | 16/DIG. 39 |
| 4,564,973 | 1/1986 | Kordes | 403/104 |
| 4,596,484 | 6/1986 | Nakatani | 403/109 |
| 4,598,572 | 7/1986 | Mondello et al. | 403/109 |

FOREIGN PATENT DOCUMENTS

| | | | |
|---|---|---|---|
| 3521705 | 12/1986 | Fed. Rep. of Germany | 16/71 |

*Primary Examiner*—Richard K. Seidel
*Assistant Examiner*—Edward A. Brown
*Attorney, Agent, or Firm*—Barry E. Deutsch; J. Bruce Hoofnagle

[57] ABSTRACT

An arm for a door closer includes a shaft rotatable about a first axis. The arm includes a first arm member having a first end connected to the shaft and rotatable therewith. A second arm member has a first end pivotably connected to a second end of the first arm member and a second end pivotably connected to a mounting bracket. The second arm member includes an open ended axially movable housing member having radially inwardly extending detent. A clamp has a first end forming the first end of the second arm and a second and forming radially expandable jaws of the clamp. The detent on the housing when disposed in a first axial position maintains the jaws in a closed position and when moved to a second axial position permits the jaws to radially expand. A link has a first end forming the second end of the second arm and a second end. A joining member is connected to the second end of the link and extends towards the clamp. The joining member is held in a fixed position by the jaws when the jaws are closed and is axially movable relative to the clamp when the jaws are radially expanded.

6 Claims, 2 Drawing Sheets

FIG. 1
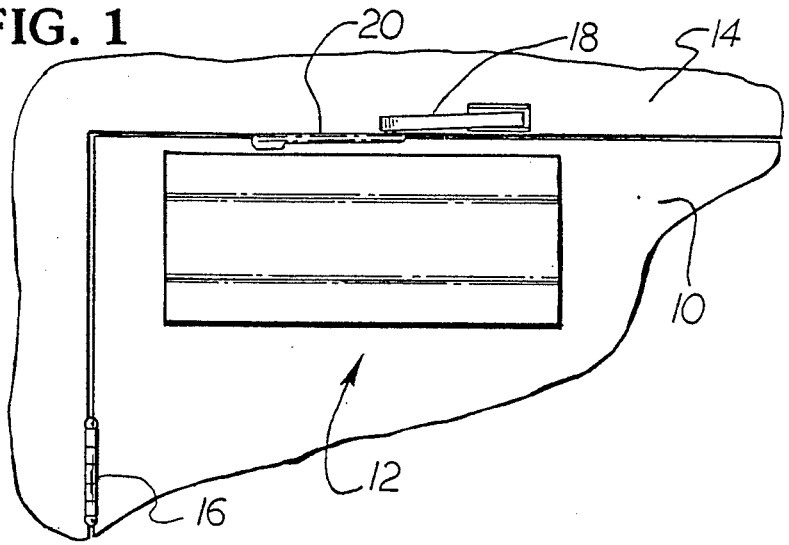
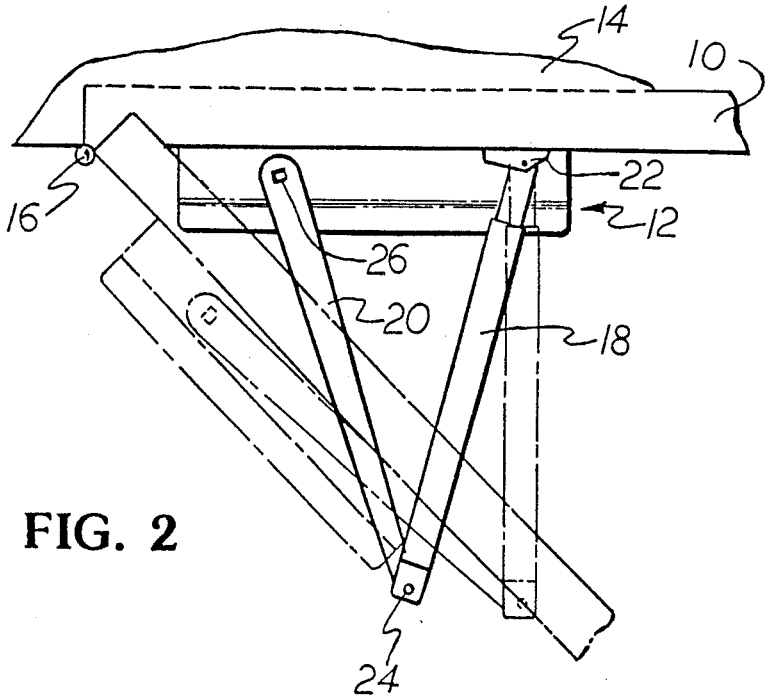
FIG. 2

46
52
44
40
54
34
38
28
36
30
18
56
35
33
25
32
50

44
46
28
38
42
18
35
33
32
25
50

28
40
33
18
35
33
32
25
50

ADJUSTABLE CLOSER ARM

BACKGROUND OF THE INVENTION

This invention relates to door closers and in particular to adjustable arms for such closers.

A door closer, usually of the spring-propelled, hydraulically restrained variety, is mounted on a door frame or a door panel. The closer is joined to the other of the panel or frame by, in most instances, a connector comprising a pair of arms. A projecting shaft of the door closer is rotated about a first axis when the door panel and the frame move relative to each other.

It is known that the location of the door closer on the door determines the degree of opening of the door. To accommodate various door closer locations, for different door closer applications, door closers have heretofore included one adjustable arm. Such adjustable arms have not been generally easy to install, easy to adjust and have required the use of tools to attain requisite adjustments. The foregoing installation and adjustment deficiencies have increased the cost of installing door closers.

Accordingly an object of this invention is a door closer having an adjustable arm, which arm may be easily adjusted without requiring the use of any tools.

SUMMARY OF THE INVENTION

The foregoing object and other objects of the invention are attained in an arm for a door closer having a shaft rotatable about a first axis, said arm comprising a first arm member having a first end connected to a shaft and rotatable therewith; a second arm member having a first end pivotably connected to a second end of the first arm member and a second end pivotably connected to a mounting bracket, said second arm member comprising an open-ended axially movable housing member having radially inwardly extending detent means, clamp means having a first end forming the first end of said second arm and a second end forming radially expandable jaws, said housing detent means when in a first axial position maintains the jaws in a closed position and when in a second axial position permits the jaws to radially expand, a link having a first end forming the second end of said second arm and a second end, and a joining member connected to the second end of said link and extending toward said clamp means, said joining member being held in a fixed position by said jaws when the jaws are closed and being axially movable relative to said clamp means when the jaws are radially expanded.

BRIEF DESCRIPTION OF THE DRAWING

FIG. 1 is an elevational view of a door closer embodying the present invention mounted on a door;

FIG. 2 is a top plan view of the door closer illustrated in FIG. 1, showing various operating positions of the door closer;

DESCRIPTION OF THE PREFERRED EMBODIMENT

Figures 3, 4, 5:
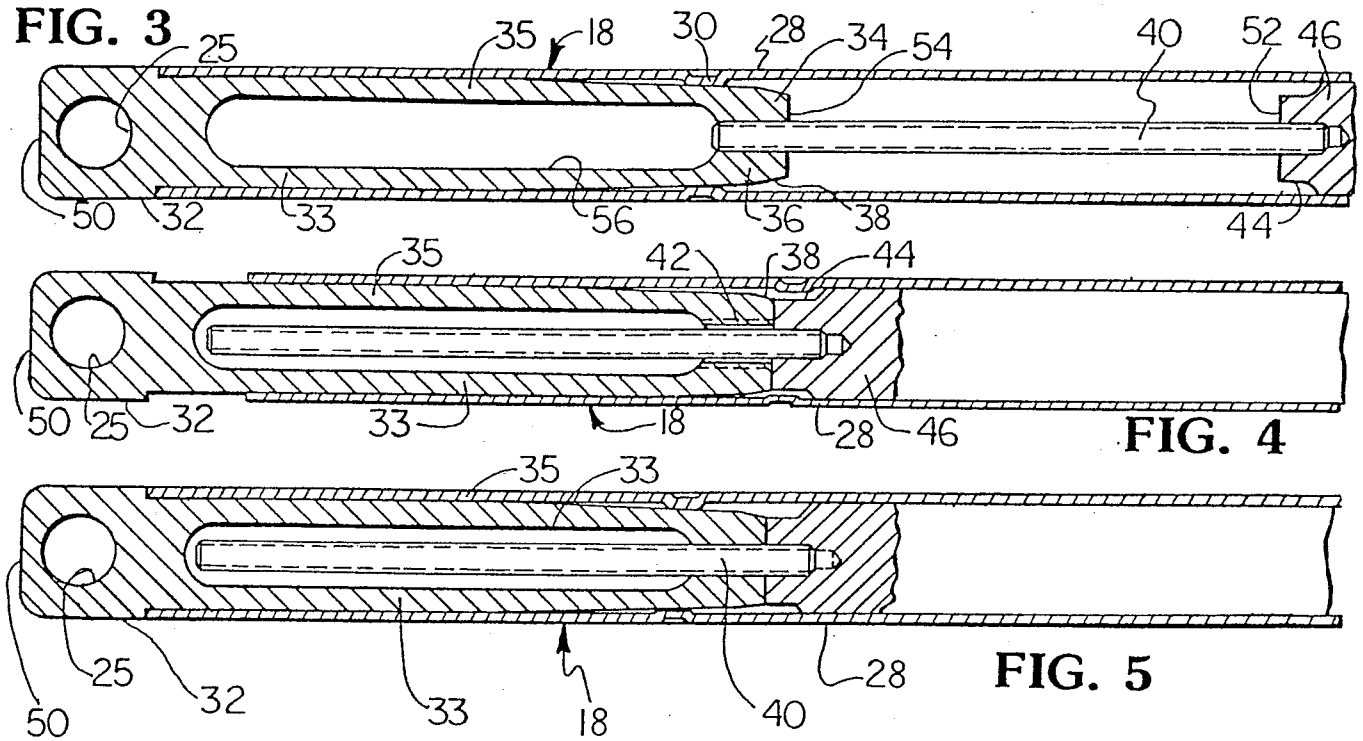
FIG. 3 is a longitudinal sectional view of the adjustable arm of the present invention when in the maximum first operating position.
FIG. 4 is a view similar to that illustrated in FIG. 3 illustrating the arm in the adjustment position.
FIG. 5 is a further longitudinal sectional view illustrating the adjustable arm in a minimum operating position.

Referring now to the various figures of the drawing, there is disclosed a preferred embodiment of the present invention. In referring to the various figures, like numerals shall refer to like parts.

In FIGS. 1 and 2, there is disclosed a door closer generally referenced by the numeral 12 mounted on a door 10. Door 10 is pivotably attached by hinges 16 (only one of which is shown) to a door jamb 14. Door closer 12 is of the type which utilizes a rack and pinion construction, with the rack forming a piston, biased to a door closed position by a spring. The foregoing construction as is well known to those skilled in the art is used to control both opening and closing movements of a door. An example of a door closer of the type described is found in U.S. Pat No. 4,665,583 issued May 19, 1987 and assigned to the same assignee hereof. Closers of the type described are sold by Emhart Industries, Inc. under the "CORBIN" trademark as Models 100, 110 and 120 or "RUSSWIN" trademarks as Models 2800, 2810 and 2820.

Closer 12 has arms 18 and 20 attached thereto. Arm 20 is connected to the pinion (not shown) of the door closer via shaft 26 and is rotatable therewith. Arm 18 is pivotably connected to arm 20 at one of its ends via shaft 24. The other end of arm 18 is pivotably attached to hinge 22. Hinge 22 in turn is connected to door jamb 14.

To enable door closer 12 to be used in varied applications, arm 18 is typically made adjustable, that is the length of the arm may be varied to meet different application needs. Heretofore, it has been necessary to use tools to adjust the length of the adjustable closer arms and it has not always been easy to attain the desired adjustment length.

Referring now to FIGS. 3 through 5 of the drawing, there is disclosed a preferred embodiment of arm 18 in accordance with the present invention. Specifically, arm 18 comprises a generally tubular housing member 28. Member 28 includes radially inwardly extending detent means 30, which as shown is defined by an inwardly extending flange-like protrusion. The portion of arm 18 including opening 25 is defined by a clamp-like link member 32. Opening 25 is employed to join arm 18 to shaft 24. Member 32 includes a base portion having opening 25 provided therethrough and a pair of axially extending legs 33, 35 telescopically received within tubular housing 28. Legs 33,35 terminate in a pair of radially expandable jaws 34, 36 preferably have threads 42 as illustrated in FIG. 4. The end of each leg 33,35 has a chamfer 38 for reason to be more fully explained hereinafter.

Arm 18 includes a second link member 46. One end of link member 46 is attached to hinge 22. The other end 52 of link member 46 is opposite the end 54 of link 32. End 52 of link member 46 has a generally chamfered surface 44. A joining member 40, shown as a threaded rod, axially connects links 32 and 46.

In FIG. 3, arm 18 is illustrated as being in a fixed position. In the position illustrated in FIG. 3, arm 18 is at its maximum length. Detent 30 of housing 28 is in engagement with the outer surface of legs 33,35 to hold the legs radially inward. Threads 42 of jaws 34,36 engage the corresponding threads of joining member 40 to maintain links 32 and 46 in a fixed position relative to each other.

If it is desired to move link 46 inwardly so as to reduce the length of arm 18 to its minimum, housing 28 is axially moved relative to end 50 of link 32 as illustrated in FIG. 4. This movement brings detent 30 in alignment with chamfer 38 so that the detent is no longer in engagement with the outer surface of legs 33,35. With the detent placed in radially spaced relation to the outer wall of the legs, the legs move radially outwardly so that the threaded portion 42 of jaws 34,36 is disengaged from the threads of joining member 40.

The disengagement of the threaded portion 42 of jaws 34,36 from the threads of member 40 enables link 46 to be axially moved from the position illustrated in FIG. 3 to the position of the link as illustrated in FIGS. 4 and 5. Such movement shortens the length of arm 18.

When link 46 has been moved to its desired position relative to link 32 so that the desired length of arm 18 has been attained, housing 28 is axially moved relative to link 32 so that detent 30 re-engages the outer surface of legs 33,35 to force the jaws 34,36 inwardly whereby threaded portion 42 re-engage the threads of joining member 40. FIG. 5 illustrates the repositioned housing 28 once the desired length for arm 18 has been attained.

It should be understood that although the length of arm 18 is only illustrated in its minimum and maximum lengths, any intermediate length of the arm can be readily attained through movement of link 46 axially relative to link 32 once housing 28 has been moved to the position illustrated in FIG. 4.

While a preferred embodiment of the present invention has been described and illustrated, the invention should not be limited thereto but may be otherwise embodied within the scope of the following claims.

What is claimed is:

1. An arm for a door closer having a shaft rotatable about a first axis, said arm comprising:

a first arm member having a first end connected to said shaft and rotatable therewith;

a second arm member having a first end pivotably connected to a second end of the first arm member and a second end pivotably connected to a mounting bracket, said second arm member comprising:

an open ended axially movable housing member having radially inwardly extending detent means, clamp means fully contained within said housing member and having a first end forming the first end of said second arm member and a second end forming radially expandable jaws, said housing detent means when in a first axial position maintains the jaws in a closed position and when in a second axial position permits the jaws to radially expand while fully contained within said housing member, a link having a first end forming the second end of said second arm member and a second end, and a joining member connected to the second end of said link and extending towards said clamp means, said joining means being held in a fixed position by said jaws when the jaws are closed and being axially movable relative to said clamp means when the jaws are radially expanded.

2. An arm for a door closer in accordance with claim 1 wherein said jaws and joining member each have complementary interfitting means, which means are in engaging relation when the jaws are closed.

3. An arm for a door closer in accordance with claim 2 wherein said clamp means has an external wall and said detent means engages said external wall for maintaining the jaws in a closed position.

4. An arm for a door closer in accordance with claim 3 wherein said detent means is disengaged from said external wall to permit the jaws to radially expand.

5. An arm for a door closer in accordance with claim 1 wherein said clamp means has an external wall and said detent means engages said external wall for maintaining the jaws in a closed position.

6. An arm for a door closer in accordance with claim 5 wherein said detent means is disengaged from said external wall to permit the jaws to radially expand.

* * * * *